United States Patent [19]

Jamar, Jr.

[11] 4,311,295

[45] Jan. 19, 1982

[54] ARTICLE SUPPORT HAVING A LOCKING ARTICLE HOLDER DETACHABLY MOUNTED ON A WALL MOUNT

[76] Inventor: Walker Jamar, Jr., 365 S. First Ave., E., Duluth, Minn. 55802

[21] Appl. No.: 86,431

[22] Filed: Oct. 19, 1979

[51] Int. Cl.[3] ..... E04G 5/06; F16L 3/08

[52] U.S. Cl. ..... 248/221.3; 248/222.2; 248/225.2

[58] Field of Search ..... 248/220.2, 221.3, 221.4, 248/222.1, 222.2, 223.3, 223.4, 224.3, 225.1, 225.2, 477, 478, 496, 495

[56] References Cited

U.S. PATENT DOCUMENTS

| | | | |
|---|---|---|---|
| 2,986,282 | 5/1961 | Brink | 248/225.2 X |
| 3,214,122 | 10/1965 | Frederickson | 248/221.4 |
| 3,507,082 | 4/1970 | Heirich | 248/221.3 X |
| 3,789,800 | 2/1974 | Steudler | 248/221.4 X |
| 4,017,943 | 4/1977 | Moore | 248/221.3 X |
| 4,067,529 | 1/1978 | Milcoy | 248/221.4 |
| 4,113,982 | 9/1978 | Glaesel | 248/221.3 X |

FOREIGN PATENT DOCUMENTS

| | | | |
|---|---|---|---|
| 236008 | 7/1974 | Fed. Rep. of Germany | 248/221.3 |

*Primary Examiner*—J. Franklin Foss
*Attorney, Agent, or Firm*—Larson and Taylor

[57] ABSTRACT

A detachable article holder which may be locked on a wall mount comprises a hook portion, a leg portion, and a locking member connected to a body portion. The hook portion pivotably engages a first wall mount surface and prevents removal of the holder from the wall mount by transverse outward movement thereof. The leg portion both allows removal of the holder when it is pivoted outwardly beyond a predetermined position such that the leg portion does not overlie a second wall mount surface and the holder may be displaced vertically for removal thereof, and prevents removal of the holder when it is pivoted inwardly beyond the predetermined position such that the leg portion overlies the second wall mount surface and prevents vertical movement of the holder. The locking member may be displaced from a first position wherein the holder may be pivoted beyond the predetermined position to a second position wherein pivoting of the holder beyond the predetermined position is prevented by abutment of the locking member with the supporting wall.

9 Claims, 7 Drawing Figures

ARTICLE SUPPORT HAVING A LOCKING ARTICLE HOLDER DETACHABLY MOUNTED ON A WALL MOUNT

FIELD OF THE INVENTION

The present invention relates in general to article support systems, and in particular to systems comprising article holders which are detachably mountable on wall mounts.

BACKGROUND OF THE INVENTION

A number of support systems for wall mounting of articles have been developed which comprise an article holder detachably mountable on a wall mount. Pertinent examples of such article supports include the supports disclosed in applicant's prior Canadian Pat. No. 917,505; the supports disclosed in the following U.S. Pat. Nos. 1,896,769 (Davis et al.), 3,019,709 (Teason), 3,297,075 (Howell et al.); and the supports disclosed in the British specification No. 885,372 (Seckerson et al.).

However, except for applicant's supports referred to above, none of the prior art supports of which applicant is aware are particularly suited to the support of pictures and the like on walls because they do not provide holders which are both readily attachable and detachable and readily lockable so as to prevent unintended or unauthorized detachment of the holders.

For example, the T-shaped double bayonet slot arrangement of the Davis et al. fasteners allows the fastener to be attached and detached to a mounting strip only by axially sliding the fastener onto the strip at one of the ends thereof. As a result, a particular fastener cannot be removed without first removing any other fasteners which are disposed between the fastener and the end of the mounting strip from which the fastener is to be removed.

In the case of the Teason bracket, the mounting arrangement thereof allows the bracket to be readily suspended from the clamp, but does not allow the bracket to be locked onto the clamp; while in the case of the Howell et al. support arrangement, the snap-locking feature thereof allows a decorating fixture to be readily attached to a support member by snap-locking, but is not adapted to facilitate detachment of the fixture once it has been attached to the support member.

Further, although applicant's earlier supports mentioned hereinabove provide a more efficacious combination of mounting and locking features than other prior art supports known to applicant, the utility of each embodiment thereof is limited in particular situations. The locking feature of the embodiments illustrated in FIGS. 2–7 of the aforementioned Canadian patent does not prevent removal of a rod from a molding if the rod is displaced in the proper combination of movements, and the locking features of the embodiments illustrated in FIGS. 8–15 require specialized locking members which complicate the manufacture of the supports. Further, applicant's earlier supports are capable of supporting articles only below the mounting moulding. As a consequence, neither the moulding nor the support members can be readily concealed.

SUMMARY OF THE INVENTION

These and other disadvantages of the prior art are overcome by an article holder constructed in accordance with the present invention. Such a holder is adapted for detachable mounting on a wall mount having a support member disposed in spaced relationship to the mounting wall, and comprises a hook portion, a leg portion, and a locking member connected to a body portion.

The hook portion is adapted to pivotably engage the wall mount support member and to prevent removal of the holder from the wall mount by transverse outward movement of the holder.

The leg portion is adapted to allow the holder, when the hook portion is operatively engaged with the support member, to be removed from the wall mount by vertical movement thereof when the wall mount is pivoted outwardly past a predetermined position, such that the body portion is inclined at an angle with respect to the vertical and the leg portion does not overlie the support member, and to prevent removal of the holder from the wall mount when the holder is pivoted inwardly past the predetermined position such that the leg portion overlies the support member and cooperates therewith to prevent vertical movement of the holder which would disengage the hook portion from the support member.

The locking member is mounted to the body portion such that is may be displaced from a first position, wherein the holder may be pivoted outwardly beyond the predetermined position when the hook portion is operatively engaged with the support member, to a second position, wherein abutment of the locking means with the wall prevents the holder from being pivoted outwardly beyond the predetermined holder position when the hook portion is operatively engaged with the support member.

In accordance with other aspects of the invention, the hook portion preferably comprises a leg member joined at an acute angle to the body portion, the leg portion forms a right angle with the body portion, and the locking member comprises an elongate rod member slidably mounted to the body portion.

In accordance with still another aspect of the invention, the wall mount support member defines a planar outer surface and the holder body portion defines a corresponding planar surface which abuts with the support member planar surface when the holder is mounted on the wall mount in the second position thereof.

Other features and advantages of the invention will be set forth in, or apparent from, the detailed description of preferred embodiments found hereinbelow.

DETAILED DESCRIPTION OF THE PREFERRED EMBODIMENTS

Figure 1:
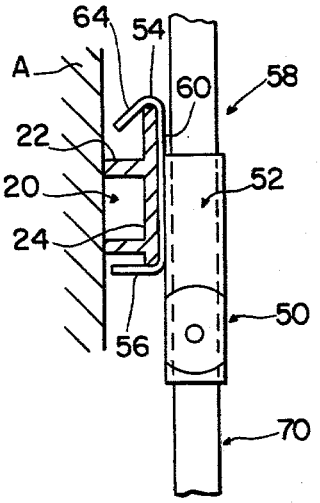
FIG. 1 is a diagrammatic side elevational view of a wall mount and a first embodiment of an article holder constructed in accordance with the present invention.

Referring to FIG. 1, an article support system constructed in accordance with the present invention will now be described. The system comprises a wall mount 20 and an article holder 50 detachably and lockably mountable thereon, as will be described in more detail herein below.

Figure 2:
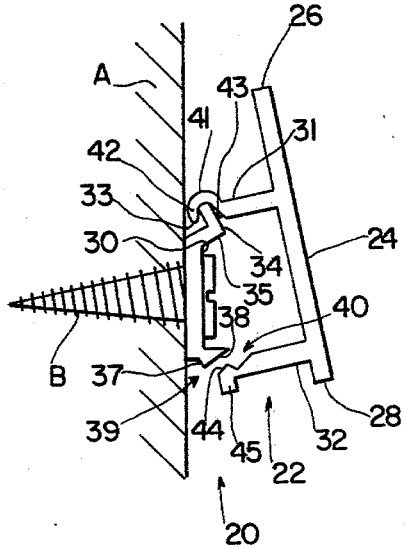
FIG. 2 is a side elevation view of a preferred embodiment of a wall mount constructed in accordance with the present invention in a first position thereof.

Wall mount 20, which has been diagrammatically shown in FIG. 1, generally comprises a base portion 22 for attachment to a wall A or other vertical supporting surface, and a support member 24 joined to base portion 22 so as to be disposed in spaced relationship to wall A. Base portion 22 may be of any conventional configuration, and may be integral with or detachable from support member 24. A preferred embodiment of wall mount 20 having a detachable base portion is illustrated in FIG. 2 and comprises a mounting strip 30 fastened to wall A by screws B or other conventional fasteners, and a pair of spaced legs, denoted 31 and 32, respectively, joined to support member 24 and adapted to cooperate with mounting strip 30 in a "snap-fit" relationship.

As shown, the upper edge portion of mounting strip 30 is angled or bent to form a notch or channel 33 for receiving the distal end of leg 31, and a projecting leg 34 inclined from the vertex 35 of the angle portion relatively upwardly toward wall A such that the distal end of leg 34 is spaced from wall A by a predetermined distance. The lower edge portion of mounting strip 30 is shaped as shown so as to define angled surfaces 37 and 38, which intersect to define a generally V-shaped, downwardly facing projection 39 spaced from wall A by a predetermined distance. Projection 39 cooperates with a correspondingly shaped and upwardly facing notch or channel 40 formed in leg 32 when leg 32 is operatively engaged with mounting strip 30. As will be appreciated by those of ordinary skill in the art, the angle of surface 37 and the corresponding surface of channel 40 with respect to mounting wall A determines the degree of difficulty with which projection 39 and channel 40 may be disengaged. The more nearly surface 37 is parallel to mounting wall A, the more difficult is disengagement of projection 39 from channel 40. Conversely, the more nearly surface 37 is perpendicular to mounting wall A, the easier is disengagement of projection 39 from channel 40. If surface 37 is parallel to mounting wall A, projection 39 and channel 40 are effectively locked together once they have been brought into operative engagement.

Legs 31 and 32 are spaced from one another such that at least one of the legs must be flexed away from the other leg in order to allow both legs to operatively engage mounting strip 30. Advantageously, at least leg 32 is made of a relatively resilient material for this purpose.

Figure 3:
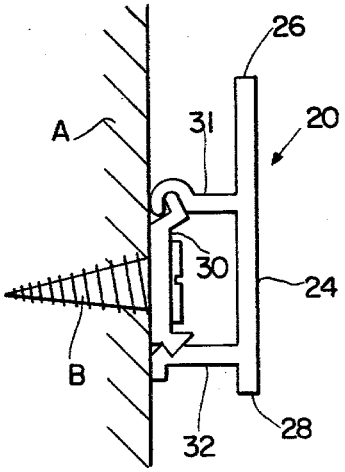
FIG. 3 is a side elevation view of the wall mount of FIG. 2 in a second position thereof.

Leg 31 is configured as shown to define a curved hook portion 41 having a downwardly depending distal leg 42 which is adapted to be received in channel 33 of mounting strip 30. Leg 42 has a tapering thickness and the bight 43 of hook portion 41 is configured such that support member 24 may be pivoted between an inclined position as shown in FIG. 2 to a vertical position, as shown in FIG. 3, when hook portion 41 of leg 31 is operatively engaged with mounting strip 30.

In addition to channel 40 referred to hereinabove, leg 32 is also advantageously provided with an inclined upwardly facing surface 44 which extends from channel 40 to the end of leg 32, as shown. Surface 44 has an angle of inclination corresponding to that of surface 38 such that when support member 24 is pivoted to engage leg 32 with mounting strip 30, surface 44 slides against surface 38 and a camming action is produced which bends or flexes leg 32 sufficiently to allow mating, "snap-fit" engagement of projection 39 and channel 40.

Leg 32 is further advantageously formed at the distal end thereof with a depending projection 45 which has a planar outer face, as shown, that abuts wall A when leg 32 is operatively engaged with mounting strip 30. Projection 45 functions to positively position the bottom of support member 24 relative to the wall and to stiffen and reinforce longitudinally leg 32 so as to maintain operative engagement with mounting strip 30 throughout its length.

Support member 24 advantageously is planar in shape, and is joined substantially orthogonally to legs 31 and 32, as shown. As will be apparent to those of ordinary skill in the art, supporting member 24 and legs 31 and 32 may be formed as a single, integral channel member. As shown, support member 24 defines upper and lower edges, denoted 26 and 28, respectively, with upper edge 26 disposed a predetermined distance above leg 31 to accomodate the cooperating element of article holder 50.

Figure 4:
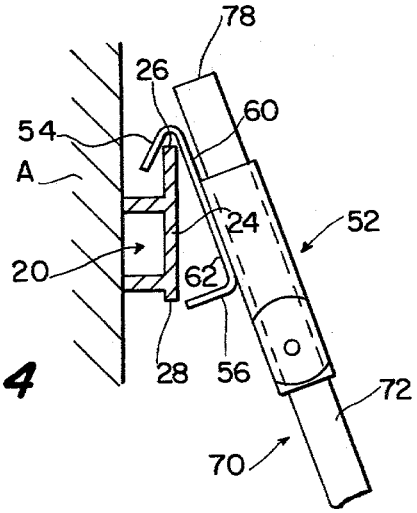
FIG. 4 is a side elevation view of the wall mount and holder of FIG. 1 with the holder in the first position thereof.
Figure 5:
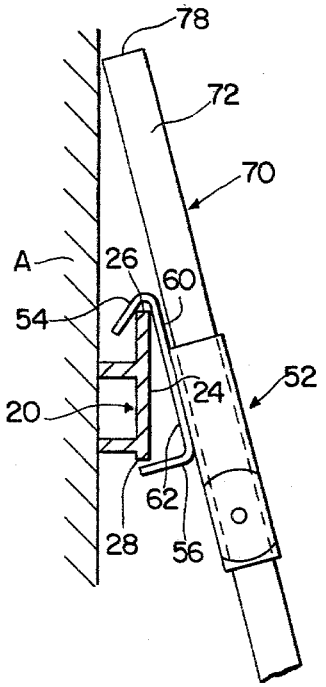
FIG. 5 is a side elevation view of the wall mount and holder of FIG. 1 in a locked configuration.

Referring to FIGS. 1, 4, and 5, article holder 50 basically comprises a body portion, generally denoted 52, and a hook portion 54, leg portion 56, and locking apparatus, generally denoted 58, connected to body portion 52.

Body portion 52 advantageously includes a base plate 60 having a flat or planar surface 62 which abuts the opposing outer face of support member 24 when article holder 50 is mounted on wall mount 20 in the article supporting position thereof, as shown in FIG. 1.

Hook portion 54 and leg portion 56 extend from body portion 52 in the same general direction and are disposed in spaced relationship with respect to each other at a distance corresponding to the distance between edges 26 and 28 of support member 24. As shown, hook portion 54 and leg portion 56 preferably are integral with base plate 60 and constitute the upper and lower edge portions, respectively, thereof.

Hook portion 54 is configured for pivotally engaging upper edge 26 of wall mount support member 24 and preventing removal of article holder 50 from wall mount 20 by transverse outward movement thereof. As shown, hook portion 54 preferably is formed by a generally straight leg member 64 joined at an acute angle to base plate 60. Advantageously, hook portion 54 allows holder 50 to be pivoted from a substantially vertical article supporting orientation, as shown in FIG. 1, wherein base plate 60 abuts support member 24, outwardly to relatively inclined orientations, as shown in FIGS. 4 and 5.

Leg portion 56 is configured both such that when hook portion 54 is operatively engaged with wall mount 20 and holder 50 is pivoted outwardly past a predetermined position, as shown in FIG. 4, such that body portion 52 is inclined at an angle with respect to the vertical and leg portion 56 does not overlie edge 28 of support member 24, holder 50 may be removed from wall mount 20 by vertical movement thereof; and such that when hook portion 54 is operatively engaged with wall mount 20 and holder 50 is pivoted inwardly past the predetermined position, as shown in FIG. 5, leg portion 56 overlies edge 28 of support member 24 and cooperates therewith to prevent vertical movement of holder 50 such as would operatively disengage hook portion 54 from support member 24, and allow holder 50 to be removed from wall mount 20 by transverse movement thereof. As shown, leg portion 56 preferably is straight and depends from base plate 60 at a right angle thereto. Further, leg portion 56 advantageously is spaced from hook portion 54 such that leg portion 56 is adjacent to or abuts lower edge 28 of support member 24 when holder 50 is mounted on wall mount 20 in the substantially vertical article supporting orientation shown in FIG. 1.

Locking apparatus 58 includes a member 70 which may be displaced from a first position, shown in FIG. 4, wherein, when hook portion 54 is operatively engaged with wall mount 20, holder 50 may be pivoted outwardly beyond the aforementioned predetermined position thereof, in which holder 50 may be removed from wall mount 20, to a second position, shown in FIG. 5, wherein abutment of member 70 with wall A prevents holder 50 from being pivoted outwardly beyond the aforementioned predetermined position, and removal of holder 50 from wall mount 20 is thereby prevented. As will be appreciated by those of ordinary skill in the art, the second position of locking member 70 which locks holder 50 on wall mount 20 is determined by the length of leg portion 56 and the spacing of holder 50 from wall A.

Figure 6:
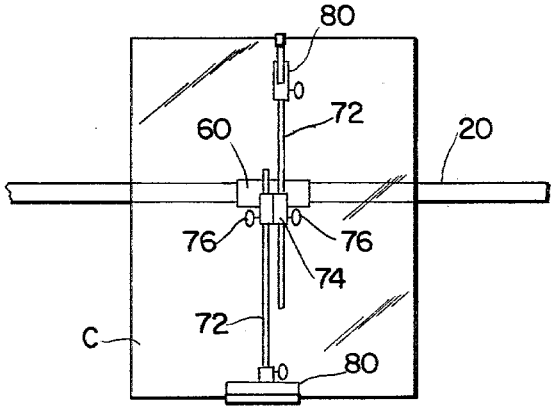
FIG. 6 and 7 are front elevation views of a second embodiment of an article holder constructed in accordance with the present invention.
Figure 7:
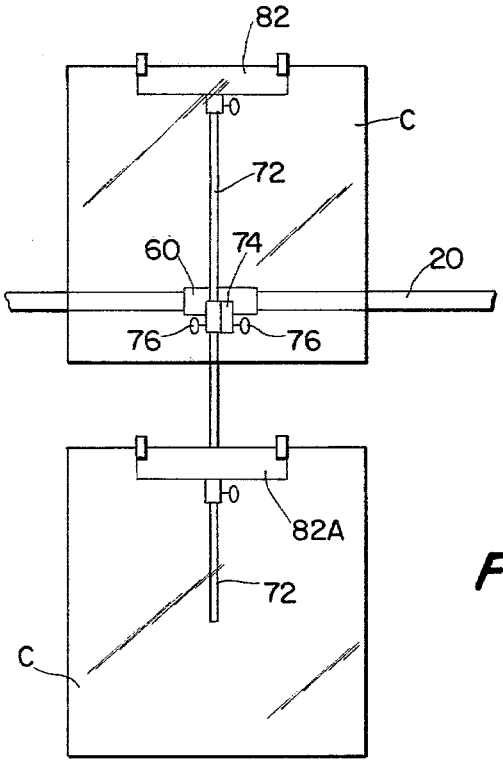

Referring to FIGS. 6 and 7, at least one elongate rod 72 advantageously constitutes member 70. Rod 72 preferably is slidably mounted for longitudinal displacement thereof in a bracket 74 joined to base plate 60 and a thumb screw 76, or other conventional fastener, mounted on bracket 74 may be provided for releasably locking rod 72 in any desired position in bracket 74. As shown in FIG. 4, when end 78 of rod 72 extends less than a predetermined distance above base plate 60, holder 50 may be pivoted outwardly sufficiently to allow removal thereof from wall mount 50, but, as shown in FIG. 5, when rod end 78 extends more than the predetermined distance above base plate 60, holder 50 cannot be pivoted outwardly sufficiently to allow removal thereof from wall mount 50 because rod end 78 abuts wall A and prevents further outward pivoting.

Referring again to FIGS. 6 and 7, holder 50 advantageously is provided with at least two rods 72 slidably mounted to base plate 60 and having conventional hook-type fasteners 80, as shown in FIG. 6, or clip-type fasteners 82, as shown in FIG. 7, or other conventional types of fasteners (not shown) mounted on opposing ends of rods 72, as shown. Such fasteners advantageously also are slidably mounted on rods 72, as is illustrated by fastener 82A in FIG. 7. As is shown, the provision of plural rods 72 allows great flexibility in the manner and arrangement in which articles such as paintings and the like, which have been diagrammatically shown and denoted C, are supported by holder 50.

It will be apparent from the foregoing description that an article holder and wall mount constructed in accordance with the present invention provides positive locking of the holder to the wall mount without sacrificing the ease with which the holder is attached or detached to the wall mount, and without the need for specialized locking mechanisms. In addition, articles may be supported both above and below the wall mount, which facilitates concealment of both the wall mount and the components of the article holder, thus providing an aesthetically more pleasing appearance of the article(s) being supported. Further, the article holder and wall mount of the present invention are characterized by the simplicity of their construction and manufacture.

Although the invention has been described with respect to exemplary embodiment thereof, it will be understood that variations and modifications can be effected in the embodiments without departing from the scope or spirit of the invention.

I claim:

1. An article holder for pictures, displays and the like, means detachably mounting the same on a wall, a wall mount adapted to be secured to a wall having a support member disposed in close but spaced relationship to the wall and defining first and second support surfaces, said holder comprising a body portion; a hook portion connected to said body portion for pivotably engaging a first one of the support member support surfaces and preventing removal of said holder from the wall mount by transverse outward movement of said holder; a leg portion connected to said body portion for allowing said holder to be removed from the wall mount by vertical movement thereof when said hook portion is operatively engaged with the support member and said holder is pivoted outwardly past a predetermined position such that said body portion is inclined at an angle with respect to the vertical and said leg portion does not overlie the support member, and for preventing vertical movement of said holder which would operatively disengage said hook portion from the support member when said hook portion is operatively engaged with the support member and said holder is pivoted inwardly past said predetermined position, such that said leg portion overlies the support member and cooperates with a second one of the support member support surfaces; and locking means comprising at least one elongated member and means for slidably mounting said member to said body portion such that said locking means may be displaced from a first position, wherein said holder may be pivoted outwardly beyond said predetermined holder position when said hook portion is operatively engaged with the support member, to a second position, wherein abutment of said locking means with the wall prevents said holder from being pivoted outwardly beyond predetermined holder position when said hook portion is operatively engaged with the support member.

2. The article holder of claim 1 wherein said hook portion comprises a leg member joined at an acute angle to said body portion.

3. The article holder of claim 1 or 2 wherein said leg portion forms a right angle with said body portion.

4. The article holder of claim 1 wherein said locking means further comprises means connected to said at least one rod member for supporting an article.

5. Article support apparatus comprising in combination, a wall mount mountable to a wall and an article holder detachably and lockably mounted on said wall mount, said wall mount being comprised of a mounting strip mountable on a wall and a support member mounted on said mounting strip and having a planar outer surface and first and second legs for detachably engaging said mounting strip, said mounting strip comprising a first edge portion defining a first channel for receiving the distal end of said first leg and a second edge portion having first and second surface defining a projection for engaging a correspondingly shaped channel formed in said second leg, and said distant end of said first leg comprising a curved hook portion having a tapered depending leg such that said first leg is pivotably engagable with said mounting strip, and said holder comprising a body portion; a hook portion connected to said body portion for pivotably engaging a first one of said support member upper and lower surfaces and preventing removal of said holder from said wall mount by transverse outward movement of said holder; a leg portion connected to said body portion for pivotably engaging a first one of said support member upper and lower surfaces and preventing removal of said holder from said wall mount by transverse outward movement of said holder; a leg portion connected to said body portion for allowing said holder to be removed from said wall mount by vertical movement thereof when said hook portion is operatively engaged with said support member and said holder is pivoted outwardly past a predetermined position, such that said body portion is inclined at an angle with respect to the vertical and said leg portion does not overlie said support member, and for preventing vertical movement of said holder which would operatively disengage said hook portion from said support member when said hook portion is operatively engaged with said support member and said holder is pivoted inwardly past said predetermined position such that said leg portion overlies said support member and cooperates with a second one of said support member of upper and lower surfaces; and locking means mounted to said body portion such that said locking means may be displaced from a first position, wherein said holder may be pivoted outwardly beyond said predetermined holder position when said hook portion is operatively engaged with the support member, to a second position, wherein abutment of said locking means with the wall prevents said holder from being pivoted outwardly beyond said predetermined holder position when said hook portion is operatively engaged with said support member.

6. The article support apparatus of claim 5 wherein said body portion defines a flat surface which abuts said wall mount outer surface when said holder is operatively engaged with said wall mount in an article supporting position.

7. The article support apparatus of claim 5 wherein said first and second surfaces are angled with respect to each other such that said projection is generally V-shaped, and said first surface is inclined with respect to and faces the wall such that said projection is releasably engageable with said second channel.

8. The article support apparatus of claim 5 wherein at least said second leg must be flexed to allow engagement of said projection with said second channel, and said second leg comprises a third angled surface extending from said second channel toward the distal end of said second leg for engaging said second angled surface as said second leg is pivoted into engagement with said mounting strip and producing a camming action which flexes said second leg to allow mating engagement of said projection and said second channel.

9. The article support apparatus of claim 5 wherein the first and second surfaces are angled with respect to each other such that said projection is generally V-shaped, and said first surface is parallel to and faces the wall such that said projection and said second channel are locked together when in operative engagement with each other.

* * * * *